United States Patent [19]

Inoue

[11] 4,142,505

[45] Mar. 6, 1979

[54] IGNITION SYSTEM MEANS FOR A ROTARY PISTON ENGINE

[75] Inventor: Takashi Inoue, Toyota, Japan

[73] Assignee: Toyota Jidosha Kogyo Kabushiki Kaisha, Toyota, Japan

[21] Appl. No.: 791,684

[22] Filed: Apr. 28, 1977

[30] Foreign Application Priority Data

Dec. 27, 1976 [JP] Japan ..... 51-159178

[51] Int. Cl.[2] ..... F02B 53/12

[52] U.S. Cl. ..... 123/211

[58] Field of Search ..... 123/8.09, 117 R, 148 DS

[56] References Cited

U.S. PATENT DOCUMENTS

| | | | |
|---|---|---|---|
| 3,584,608 | 6/1971 | Shibagaki | 123/148 DS X |
| 3,752,128 | 8/1973 | Tatsutomi et al. | 123/148 DS X |
| 3,957,020 | 5/1976 | Sasaki et al. | 123/8.09 X |
| 3,970,049 | 7/1976 | Yamaguchi et al. | 123/148 DS X |

*Primary Examiner*—Carlton R. Croyle
*Assistant Examiner*—Michael Koczo, Jr.
*Attorney, Agent, or Firm*—Stevens, Davis, Miller & Mosher

[57] ABSTRACT

An ignition system means for a rotary piston engine having a leading and a trailing ignition plug and incorporating an exhaust gas recirculation system. A control circuit is disclosed which selectively stops or delays the sparking operation of the trailing ignition plug only when the three conditions are simultaneously satisfied: that the throttle opening is in a medium range for effecting a low load operation of the engine; that the engine rotational speed is below a predetermined relatively low value; and that the exhaust gas recirculation ratio is below a predetermined relatively moderate value.

8 Claims, 2 Drawing Figures

IGNITION SYSTEM MEANS FOR A ROTARY PISTON ENGINE

BACKGROUND OF THE INVENTION

1. Field of the Invention:

The present invention relates to an ignition system means for a rotary piston engine and, more particularly, an improvement of a dual type ignition system means for a rotary piston engine having a leading and a trailing ignition plug.

2. Description of the Prior Art:

A rotary piston engine such as the Wankel type is often equipped with two ignition plugs spaced along the rotational direction of the rotor for improving the engine performance. An ignition plug located at the leading side of the other ignition plug as seen in the rotational direction of the rotor is called a leading ignition plug while the other is called a trailing ignition plug, wherein the two ignition plugs are independantly operated by individual electric circuits. With regard to the rotary piston engines having the leading and trailing ignition plugs, it is known that the emission of noxious components, particularly HC and CO in the exhaust gases is substantially reduced by stopping or delaying the sparking operation of the trailing ignition plug in a certain operational condition of the engine. This improvement of the exhaust gas emmission is considered to be effective because when the sparking operation of the trailing ignition plug is stopped or delayed, the combustion of the fuel-air mixture in the engine combustion chamber is extended downstream into the exhaust manifold and the manifold reactor is thereby maintained at a high temperature thereby effecting a better recombustion of the uncombusted components contained in the exhaust gases, thus accomplishing a better overall combustion of the fuel. However, this method is effective only in a particular operating condition of the engine, which is generally the idling operation and a low load low speed operation except the engine breaking condition. In view of this feature, an ignition system means which operates in a manner to stop or delay the sparking operation of the trailing ignition plug in the idling and a low speed low load operation except the engine breaking condition, is proposed as disclosed in Japanese Patent publication No. 15523/73.

On the other hand, in order to comply with the regulations which are getting stricter with respect to the limit of NOx, it is contemplated to incorporate an exhaust gas recirculation system also in the rotary piston engine.

In experimental research with regard to rotary piston engines having leading and trailing ignition plugs and incorporating exhaust gas recirculation system, the inventor of the present invention noted that if the sparking operation of the trailing ignition plug is stopped or delayed while the exhaust gas recirculation above a certain relatively moderate ratio is performed, the engine performance and the drivability of the vehicle are substantially deteriorated.

SUMMARY OF THE INVENTION

It is therefore the object of the present invention to deal with the aforementioned problem with regard to the rotary piston engines having leading and trailing ignition plugs and incorporating are exhaust gas recirculation system and to ensure a high performance operation of the rotary piston engine of the aforementioned type throughout the entire operational region of the engine while maintaining the emmission of noxious components in the exhaust gases within a desirable limit.

In accordance with the present invention, the above-mentioned object is accomplished by providing an ignition system means for a rotary piston engine having a leading and a trailing ignition plug and incorporating an exhaust gas recirculation system, comprising a control circuit which selectively stops or delays the sparking operation of said trailing ignition plug in accordance with the throttle opening, the engine rotational speed and the exhaust gas recirculation ratio in a manner such that the sparking operation of said trailing ignition plug is stopped or delayed when the throttle opening is in a medium range for effecting a low load operation of the engine, the engine rotational speed is below a predetermined relatively low value and the exhaust gas recirculation ratio is below a predetermined relatively moderate value.

By employing the system means of the present invention, when the engine is operating in the idling or low load low speed condition except the engine braking condition, the sparking operation of the trailing ignition plug is stopped or delayed if the exhaust gas recirculation ratio is below a predetermined relatively moderate value thereby maintaining a high temperature in the exhaust manifold or the manifold reactor even in these operating conditions thereby accomplishing a high rate of purification of the exhaust gases, whereas, if the exhaust gases recirculation ratio is increased beyond the predetermined value, the temporary stopping or delaying of the sparking operation of the trailing ignition plug is automatically discontinued to avoid deterioration of the engine performance and the drivability of the vehicle which will be caused by an over-suppressing of the combustion of fuel in the combustion chamber.

BRIEF DESCRIPTION OF THE DRAWING

The present invention will be more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
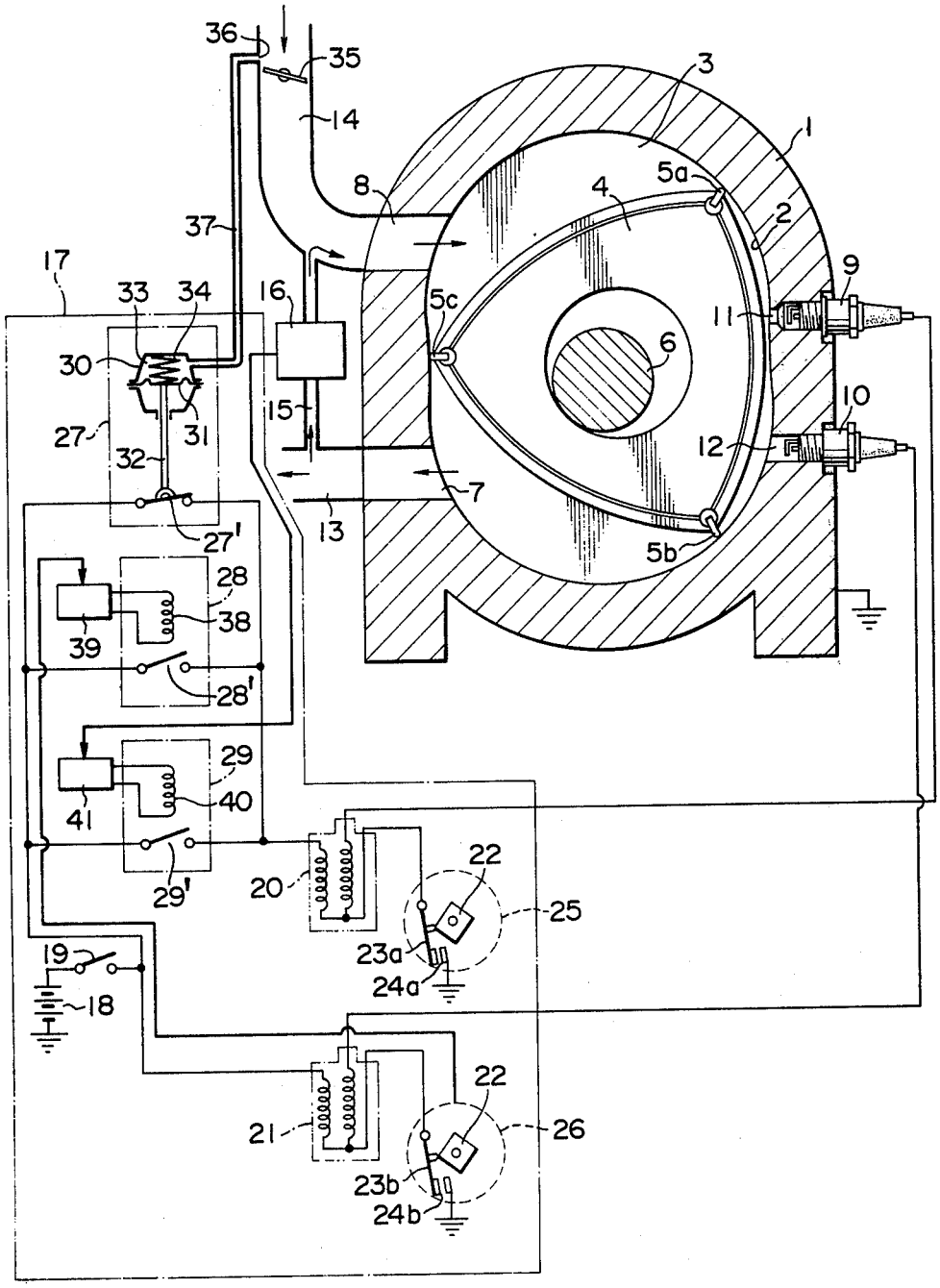
FIG. 1 is a diagram showing an embodiment of the ignition system means of the present invention.

Referring to FIG. 1, 1 designates a rotor housing of a rotary piston engine, said rotor housing having a trochoidal inner peripheral surface 2 and open opposite ends which are closed by side housings 3, thus providing an engine casing in which a polygonal rotor 4 is mounted to eccentrically rotate around an eccentric shaft with apex seals 5*a*–5*c* mounted at its apex portions sliding over the trochoidal inner peripheral surface 2. Adjacent a short axis portion of the trochoidal inner peripheral surface, the rotor housing has an exhaust port 7 provided at the trailing side of the short axis portion and an intake port 8 provided at the leading side of the short axis portion, as seen in the rotational direction of the rotor adjacent the other short axis portion of the trochoidal inner peripheral surface, the rotor housing is equipped with two ignition plugs 9 and 10 located as spaced along the rotational direction of the rotor, wherein the plug 9 located at the trailing side of the short axis portion is called a trailing ignition plug, while the plug 10 provided at the leading side of the short axis portion is called a leading ignition plug. The sparking gaps of the ignition plugs are exposed in spark plug holes 11 and 12 which open in the trochoidal inner peripheral surface.

The exhaust port 7 is connected with an exhaust pipe or manifold 13, while the intake port 8 is connected with an intake tube or manifold 14. A part of the exhaust gases discharged from the exhaust port 7 to the exhaust pipe or manifold 13 is recirculated to the intake tube or manifold 14 through an exhaust gas recirculation passage 15 including an exhaust gas recirculation control valve 16.

17 generally designates the ignition system means incorporating the present invention and adapted to supply a controlled ignition current to the trailing and leading ignition plugs 9 and 10. The ignition system means includes conventional devices or elements such as a battery 18, an ignition switch 19, a first ignition coil 20 for the trailing ignition plug, a second ignition coil 21 for the leading ignition plug, a cam 22 adapted to be rotated in accordance with the rotation of the eccentric shaft, breaker arms **23*a* and 23*b* adapted to be driven by the cams to open or close contact points 24*a* and 24*b* in accordance with the rotation of the cams, wherein the cam 22, breaker arm 23*a* and contact point 24*a* form a first contact breaker means 25 for the trailing ignition plug while the cam 22, breaker arm 23*b* and contact point 24*b* form a second contact breaker means 26 for the leading ignition plug. The ignition coil 21 for the leading ignition plug is constantly supplied with the electric current from the battery 18 when the ignition switch 19 is closed, while the ignition coil 20 for the trailing ignition plug is supplied with the electric current of the battery 18 through a parallel circuit of a pressure switch 27 and first and second electro-magnetic switches 28 and 29 so that the ignition coil 20** is supplied with the electric current when at least one of these three switches is closed.

The pressure switch 27 includes a contact point means 27' and a diaphragm means 30 for operating the contract means 27'. The diaphragm means 30 includes a diaphragm 31, an actuating rod 32, a diaphram chamber 33 and a compression coil spring 34. The diaphragm chamber 33 is adapted to be supplied with the intake vacuum when the throttle valve 35 is opened beyond a predetermined opening which effects a low load low speed operation of the engine, wherein the vacuum is conducted through a port 36 and a vacuum passage 37. The diaphragm means 30 is adapted to close the contact point means 27' when the vacuum supplied to the diaphragm chamber is smaller than the predetermined value which corresponds to the vacuum generated in the low speed low load operation of the engine while it opens the contact point means 27' when a vacuum larger than the predetermined value is supplied to the diaphragm chamber 33. Therefore, the pressure switch 27 is opened when the engine is operating in a low load low speed condition and is closed when the engine is in the idling or engine braking condition with the throttle valve 35 being closed or when the engine is operating in a medium to high load condition with the throttle valve being opened beyond the aforementioned small opening.

The first electro-magnetic switch 28 includes a contact point means 28' and a solenoid 38 for actuating the contact point means. The solenoid 38 is selectively energized by an energizing circuit means 39 which operates in accordance with the engine rotational speed in a manner such that it energizes the solenoid 38 when the engine rotational speed is below a predetermined relatively low value. The signal representing the engine rotational speed for control of the solenoid energizing means 39 may conveniently be taken from contact breaker means 26 as diagrammatically shown in FIG. 1. Therefore, the first electro-magnetic switch 28 is opened when the rotational speed is below a predetermined relatively low value and is closed when the engine rotational speed increases beyond the predetermined value as in a medium and high speed operation.

The second electro-magnetic switch 29 includes a contact point means 29' and a solenoid 40. The solenoid 40 is selectively energized by an energizing circuit means 41 which operates in accordance with the exhaust gas recirculation ratio in a manner such that it energizes the solenoid 40 when the exhaust gas recirculation ratio is below a predetermined relatively moderate value. The signal representing the exhaust gas recirculation ratio for the control of the solenoid energizing means 41 may conveniently be taken from the exhaust gas recirculation control valve 16 as diagrammatically shown in FIG. 1. Therefore, the second electro-magnetic switch 29 is opened when the exhaust gas recirculation ratio is below the predetermined value while it is closed when the exhaust gas recirculation ratio increases beyond the predetermined value.

Thus, in operation, the temporary stopping of the sparking operation of the trailing ignition plug 9 is effected only when all the three switches 27, 28 and 29 are simultaneously opened, i.e. when the three conditions that the throttle opening is in a medium range for effecting a low load operation of the engine, that the engine rotational speed is below a predetermined relatively low value and that the exhaust gas recirculation ratio is below a predetermined relatively moderate value, are simultaneously satisfied. In other words, even when the engine is operating in a low load low speed condition, if a relatively high rate of exhaust gas recirculation is in effect so that the ratio exceeds the predetermined value, the sparking operation of the trailing ignition plug 9 is not stopped thereby avoiding over-suppressing of the combustion of fuel in the combustion chambers, thus ensuring a high engine performance and a good drivability of the vehicle. When the rotational speed or the load of the engine has increased beyond a low load low speed operating condition, the temperature in the exhaust manifold or manifold reactor is automatically maintained at a sufficiently high temperature required for a satisfactory recombustion purification of the uncombusted components contained in the exhaust gases and, consequently, any suppression of the combustion of fuel in the combustion chambers such as applied by the temporary stoppage of the sparking operation of the trailing ignition plug is not required or will even cause a reverse effect.

Figure 2:
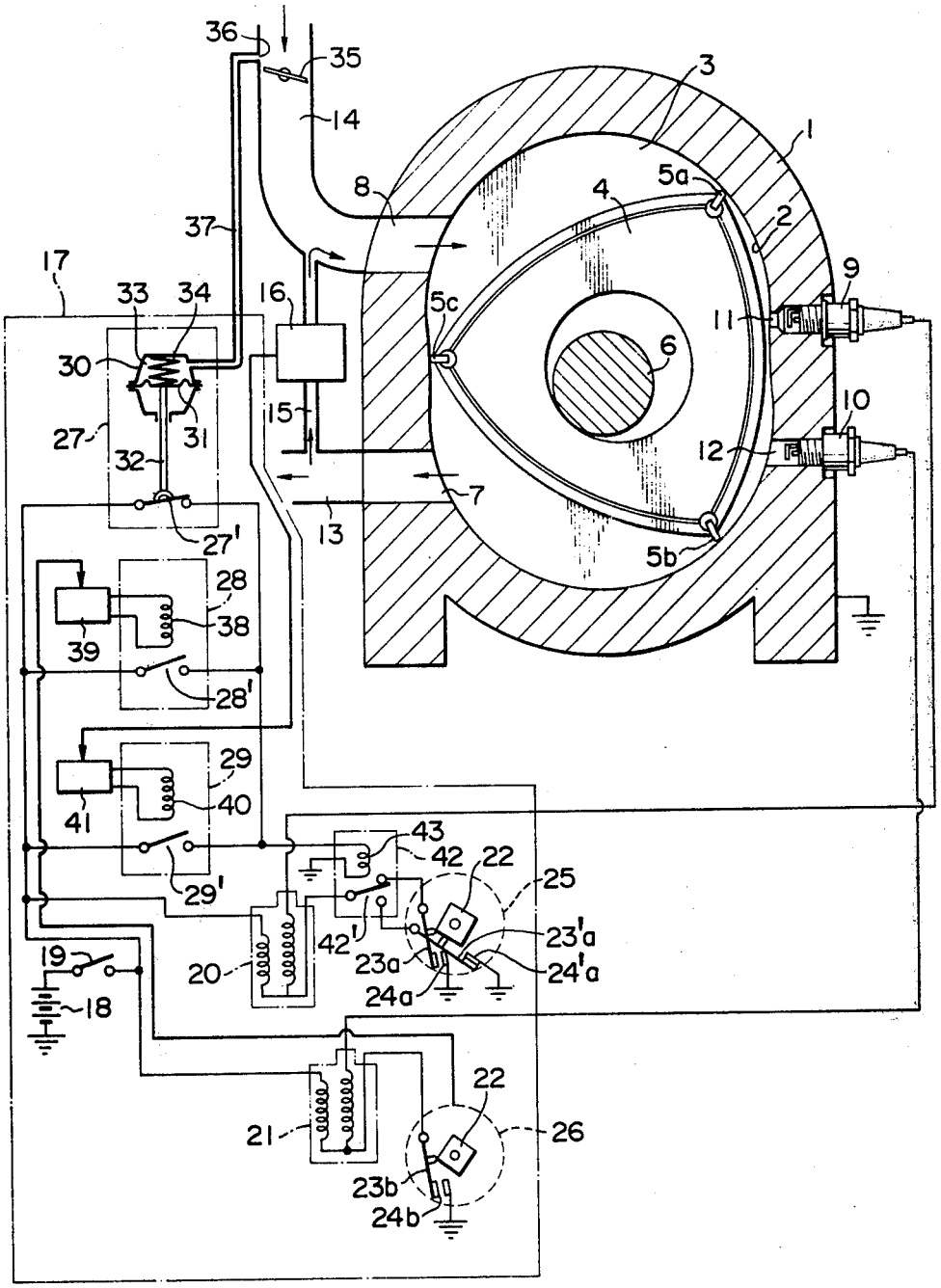
FIG. 2 is a view similar to FIG. 1 showing another embodiment of the present invention.

FIG. 2 is a view similar to FIG. 1 showing another embodiment of the present invention, wherein the sparking operation of the trailing ignition plug is temporarily delayed instead of being stopped. In FIG. 2, the portions corresponding to those shown in FIG. 1 are designated by the same reference numerals. In the ignition system means shown in FIG. 2, the contact breaker means 25 for the trailing ignition plug further includes a second breaker arm **23*a*' and second contact points 24*a*'** which are actuated with a little delay in turning as compared with the first contact points 24a. The operation of the first contact points 24a and the second contact points 24a' is switched over by a solenoid switch 42 including a contact point means 42' and a solenoid 43. When the solenoid 43 is energized, i.e. when at least one of the switches 27, 28 and 29 is closed, the contact point means 42' is switched over to the position for actuating the first contact point means 24a thereby effecting normal sparking operation of the trailing ignition plug. By contrast, if all three switches 27, 28 and 29 are opened, solenoid 43 is de-energized thereby changing over the contact point means 42' to the position for actuating the second contact point means 24a'. In this condition, the sparking operation of the trailing ignition plug is delayed thereby moderating the combustion of fuel in the combustion chambers when the engine is operating in a condition such that the throttle opening is in a medium range for effecting a low load operation of the engine, the engine rotational speed is below a predetermined relatively low value and the exhaust gas reciculation ratio is below a predetermined moderate value.

The particular operational conditions for the ignition system means of the present invention such as a particular engine rotational speed below which the electromagnetic switch 28 is opened and a particular exhaust gas recirculation ratio below which the electromagnetic switch 29 is opened will be readily determined by some judicious experiments for any particular design of the rotary piston engine. Furthermore, although the systems shown in FIGS. 1 and 2 are designed for a monorotor rotary piston engine, the system will easily be adapted to any multi-rotor rotary piston engine.

Although the invention has been shown and described with respect to some preferred embodiment thereof, it should be understood by those skilled in the art that various changes and ommissions of the form and detail thereof may be made therein without departing from the spirit of the invention.

I claim:

1. An ignition system means for a rotary piston engine having a throttle valve for controlling the air intake to the engine; leading and trailing ignition plugs, and an exhaust gas recirculation system including an exhaust gas recirculation control valve, said ignition system means comprising a first ignition circuit connected to operate said trailing ignition plug, a second ignition circuit connected to operate said leading ignition plug, and a control means including a first detecting means which detects the opening of said throttle valve, a second detecting means which detects the rotational speed of the engine, and a third detecting means which detects the opening of said exhaust gas recirculation control valve, said control means being connected to selectively interrupt said first ignition circuit in such a manner that the sparking operation of said trailing ignition plug is stopped when the throttle opening is in a medium range for effecting a low load operation of the engine, the engine rotational speed is below a predetermined relatively low value and the exhaust gas recirculation ratio is below a predetermined relatively moderate value.

2. The ignition system of claim 1, wherein said first detecting means includes a first switch connected to open when the throttle opening is in said medium range, said second detecting means includes a second switch connected to open when the engine rotational speed is below said predetermined relatively low value, and said third detecting means includes a third switch connected to open when the exhaust gas recirculation ratio is below said predetermined relatively moderate value, and wherein said control means includes a parallel circuit of said first, second and third switches which controls the supply of electric current to said first ignition circuit.

3. The ignition system means of claim 2, wherein the first detecting means further comprises an intake passage incorporating said throttle valve and a vacuum port which opens to said intake passage at a position where it is in communication with the upstream side of said throttle valve when it is in the fully closed position and which is in communication with the downstream side of said throttle valve when it is opened beyond a predetermined opening which effects a low load operation of the engine, and wherein said first switch in said parallel circuit is a pressure switch having a diaphragm means which is operated by the intake vacuum taken from said vacuum port.

4. The ignition system means of claim 2, wherein said second ignition circuit includes an ignition coil and a contact breaker means connected to control the supply of electric current to said ignition coil, and wherein said second switch in said parallel circuit is an electromagnetic switch controlled by an electric signal taken from said contact breaker means.

5. An ignition system means for a rotary piston engine having a throttle valve for controlling the air intake to the engine, leading and trailing ignition plugs, and an exhaust gas recirculation system including an exhaust gas recirculation control valve, said ignition means comprising a first ignition circuit connected to operate said trailing ignition plug and including first and second branch circuits, said first branch circuit providing a first ignition timing while said second branch circuit provides a second ignition timing which is delayed from said first ignition timing, a second ignition circuit for operating said leading ignition plug, and a control means including a first detecting means which detects the opening of said throttle valve, a second detecting means which detects the rotational speed of the engine, and a third detecting means which detects the opening of said exhaust gas recirculation control valve, said control means being connected to selectively switch between said first and second branch circuits of said first ignition circuit in such a manner that said second branch circuit is switched on so as to delay the spark timing of said trailing ignition plug when the throttle opening is in a medium range for effecting a low load operation of the engine, the engine rotational speed is below a predetermined relatively low value and the exhaust gas recirculation ratio is below a predetermined relatively moderate value.

6. The ignition system means of claim 5, wherein said first detecting means includes a first switch connected to open when the throttle opening is in said medium range, said second detecting means includes a second switch connected to open when the engine rotational speed is below said predetermined relatively low value, and said third detecting means includes a third switch connected to open when the exhaust gas recirculation ratio is below said predetermined relatively moderate value, and wherein said control means includes a parallel circuit of said first, second and third switches and an electromagnetic fourth switch having means connected to select between operations of said first and second branch circuits so that when the fourth switch is energized, said first branch circuit is completed whereas when said fourth switch is deenergized, said second branch circuit is completed, said parallel circuit being connected to control the supply of electric current to said fourth switch.

7. The ignition system means of claim 6, further comprising an intake passage incorporating said throttle valve and a vacuum port which opens to said intake passage at a position where it is in communication with the upstream side of said throttle valve when it is in the fully closed position and which is in communication with the downstream side of said throttle valve when it is opened beyond an opening which effects a low load operation of the engine, and wherein said first switch is a pressure switch having a diaphragm means operated by the intake vacuum taken from said vacuum port.

8. The ignition system means of claim 6, wherein said second ignition circuit comprises an ignition coil and a contact breaker means connected to control the supply of electric current to said ignition coil, and wherein said second switch in said parallel circuit is an electromagnetic switch operated by an electric signal taken from said contact breaker means.

* * * * *